United States Patent [19]

Yamashita et al.

[11] Patent Number: 4,770,017

[45] Date of Patent: Sep. 13, 1988

[54] APPARATUS FOR FORMING PLATE WITH A DOUBLE-CURVED SURFACE

[75] Inventors: Isamu Yamashita; Toshio Yamakawa, both of Tosu, Japan

[73] Assignee: Agency of Industrial Science and Technology, Tokyo, Japan

[21] Appl. No.: 32,595

[22] Filed: Apr. 1, 1987

[30] Foreign Application Priority Data

Apr. 2, 1986 [JP] Japan ..... 61-077276
Dec. 12, 1986 [JP] Japan ..... 61-297130

[51] Int. Cl.[4] ..... B21D 11/20; B21B 31/16

[52] U.S. Cl. ..... 72/168; 72/173; 72/177

[58] Field of Search ..... 72/168, 170, 171, 173, 72/174, 177, 178

[56] References Cited

U.S. PATENT DOCUMENTS

| | | | |
|---|---|---|---|
| 257,963 | 5/1882 | Medart | 72/173 |
| 306,562 | 10/1884 | Vincent | 72/173 |
| 1,038,606 | 9/1912 | Lawrence | 72/173 |
| 2,868,265 | 1/1959 | Williams | 72/168 |
| 4,530,225 | 7/1985 | Meurer et al. | 72/181 |

FOREIGN PATENT DOCUMENTS

| | | | |
|---|---|---|---|
| 618159 | 9/1935 | Fed. Rep. of Germany | 72/173 |
| 2413931 | 10/1975 | Fed. Rep. of Germany | 72/170 |
| 3041212 | 5/1982 | Fed. Rep. of Germany | 72/170 |
| 794890 | 2/1936 | France | 72/173 |
| 112133 | 8/1980 | Japan | 72/178 |

OTHER PUBLICATIONS

Technical Report of Japan Shipbuilding Society (1972), 1st and 2nd reports, "On Automatic Bending of Plates by the Universal Press with Multiple Piston Heads".

Advanced Technology of Plasticity 1984, vol. 1, pp. 483–488.

Report vol. 13, No. 6, (1976) of Mitsubishi Heavy Industries.

*Primary Examiner*—Daniel C. Crane

*Attorney, Agent, or Firm*—Oblon, Fisher, Spivak, McClelland & Maier

[57] ABSTRACT

Disclosed herein a method for forming plates into shapes having a double-curved surface, and an apparatus for carrying out the method. For forming a double-curved plate, a work is three-dimensionally formed by passing same through an entrance roll, flexible rolls and exit rolls which are in vertically adjusted positions relative to each other. The flexible rolls are constituted by a pair of flexible and contractibly extensible upper and lower rolls which are supported in flexed state by a plural number of bearings to define therebetween a desired bending shape. As the work is gripped between and fed through the two flexible rolls, it is imparted with a deformation across its width. Therefore, the bending form of the work can be preset by controlling the vertical positions of the bearings which support the flexible rolls, making it possible to form a double-curved plate by a simple control involving a reduced number of control points.

12 Claims, 7 Drawing Sheets

APPARATUS FOR FORMING PLATE WITH A DOUBLE-CURVED SURFACE

BACKGROUND OF THE INVENTION

1. Field of the Invention

This invention relates to a method and an apparatus for forming a plate-like work to a shape with a double-curved surface like ship's shell plates which bear a complicated three-dimensionally curved surface.

2. Description of the Prior Art

The plates with a double-curved surface, which are extensively used especially as shell plates of ships, have thus far been formed by a combination of partial pressing operation using approximate dies of the desired shape, and linear heating operation using a burner for thermoplastically bending the plates to the aimed shape with reference to a gage. However, this method necessitates, in addition to an extremely large number of dies of different shapes, manual operations for the linear heating, which require not only a great deal of time but also skilled operators with a high degree of experience and discernment.

Recently, for automating the operation of forming shell plates of ships, a research group of The Japan Shipbuilding Society proposed a universal press with multiple piston heads, having a large number of punches arrayed in the fashion of a grid on the upper and lower sides of a steel plate to be formed, varying the heights of the punches by numeric control so that a group of punches approximate a continuous die for forming a double-curved surface. However, according to this method, the number of the punches has to be increased to some extent in order to achieve satisfactory working accuracy, resulting in production facilities of unduly large size and involving an extremely large number of control points.

Further, Technical Report Vol. 13, No. 6 (1976) of Mitsubishi Heavy Industries, Ltd. proposes a triple-raw-press for forming a double-curved surface, realizing a reduction of the number of control punches to 30 units, which is a remarkable reduction as compared with the afore-mentioned universal press with multiple piston heads but still requires a large number of punches.

Although the punch heads are mounted on spherical seats to permit head tuning motions relative to the respective punch rods in both of the afore-mentioned universal press and triple-row-press, the punch heads are necessarily deviated in tilted directions from the respective centers during the head turning motions. The paired punches which are located on the upper and lower sides of a work are deviated in the opposite directions since the direction of curvature on one side of the work is reversed as compared with the direction on the other side of the work. Consequently, the upper and lower punch heads are caused to contact and press the work at different points, resulting in a deteriorated double-curved surface formability.

SUMMARY OF THE INVENTION

It is an object of the present invention to provide a method and an apparatus for forming plates with a double-curved surface which can reduce the number of control points and drastically facilitate the operation in controlling the positions of pressing members to be contacted with a work for bending the same.

It is another object of the invention to provide a method and an apparatus for forming a plate with a double-curved surface employing paired upper and lower flexible rolls for bending a plate and capable of bending the plate to a desired shape simply by controlling vertical positions of bearings which support intermediate portions of the upper and lower flexible rolls.

It is still another object of the invention to provide a method and an apparatus for forming plates with a double-curved surface in which works are fed by rotationally driving the flexible rolls, thereby simplifying the production facilities to a considerable degree as compared with a process incorporating other drive means.

It is a further object of the invention to provide a method and an apparatus of the sort as mentioned above, in which the paired upper and lower flexible rolls for forming a plate are constantly held in face-to-face positions to ensure satisfactory double-curved surface formability.

According to an aspect of the present invention, the above-mentioned objects are achieved by the provision of a method for three-dimensionally forming a plate by passing same successively through an entrance rolls, flexible rolls and exit rolls which are held in vertically adjusted positions, the method being characterized by: providing a pair of flexible and contractibly extensible rolls positioned perpendicularly to the path of travel of the work and retained in a desired curved form by means of a plural number of vertically adjustable bearings; gripping a work between the flexible rolls and feeding same by rotationally driving the flexible rolls; three-dimensionally forming the work by imparting thereto a deformation in the transverse direction by the flexible rolls and imparting a deformation in the longitudinal direction by way of the vertical positional relationship of the flexible rolls with the entrance and exit rolls.

According to another aspect of the invention, there is also provided a plate forming apparatus which is provided with a pair of flexible and contractibly extensible rolls disposed perpendicular to the path of the work, and each constituted by fitting forming roll members fixedly at predetermined intervals on a flexible and contractibly extensible rotational shaft, the forming roll members being supported by vertically adjustable bearings independently tiltable in a plane perpendicular to the path of travel of the work, and the flexible rolls being connected to rotational drive shafts which rotate the two rolls in opposite directions.

The above and other objects, features and advantages of the invention will become apparent from the following description and the appended claims, taken in conjunction with the accompanying drawings.

BRIEF DESCRIPTION OF THE DRAWINGS

In the accompanying drawings which show a preferred embodiment and experimental examples.

DESCRIPTION OF PREFERRED EMBODIMENTS

Figure 1:
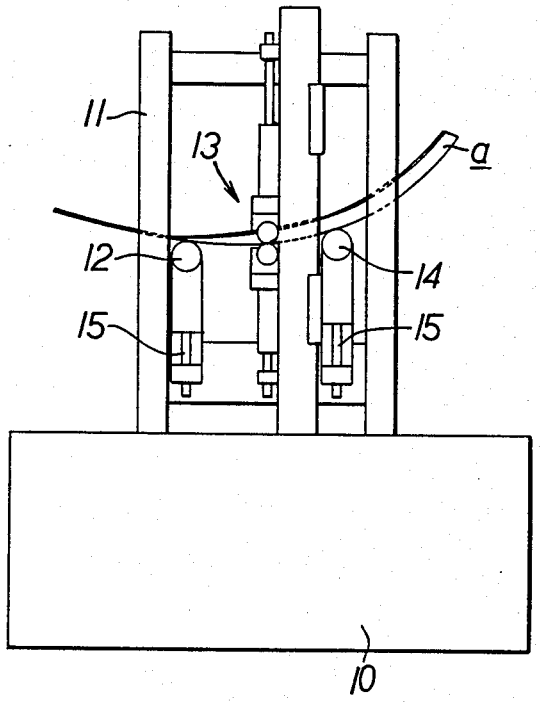
FIG. 1 is a schematic side view of an apparatus suitable for carrying out the present invention.

Referring to FIG. 1, there is schematically shown an apparatus for carrying out the present invention, which has an entrance roll 12, flexible rolls 13 and exit rolls 14 mounted at predetermined intervals on a machine frame 11 on a base 10 in the just-mentioned order. The entrance roll 12 consists of a cylindrical roll which has a length substantially same as the width of the work a, and the exit roll 14 consists of one or a plural number of short and flat rolls partly contacting the work which has undergone the bending operation. These entrance and exit rolls are preferred to be fixable in arbitrary positions on the roll shafts. In this particular embodiment shown, these rolls 12 and 14 are supported at their opposite ends on the machine frame 11 and separately adjustable in the vertical direction by means of feed screws 15. As will be described in greater detail hereinlater, the work a is bent and formed as it is passed successively through the entrance roll 12, flexible rolls 13 and exit rolls 14.

Figure 2:
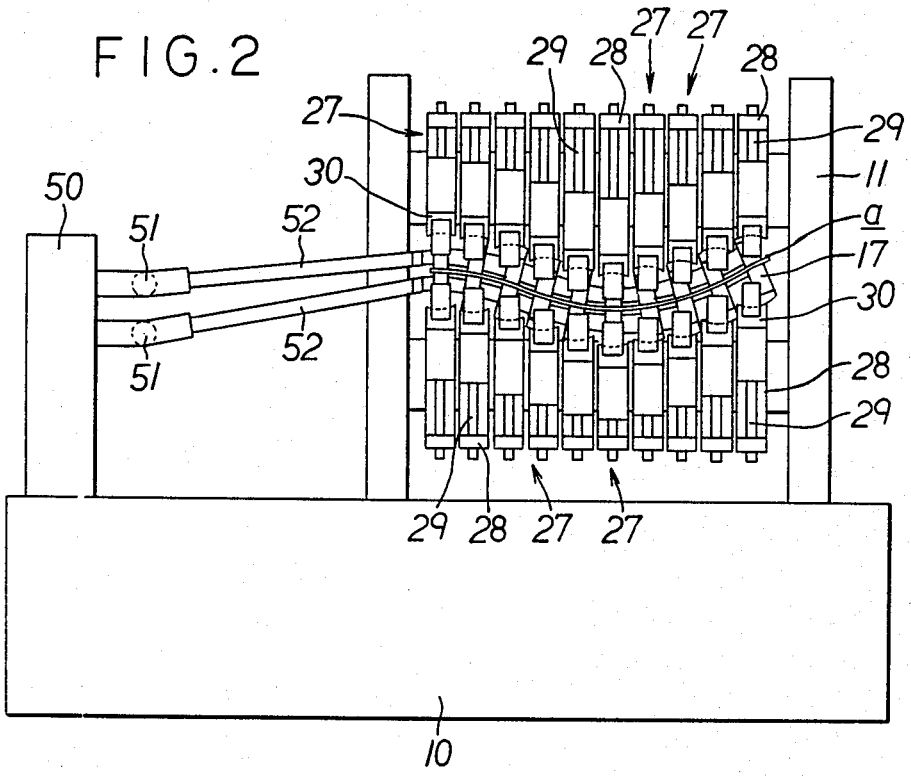
FIG. 2 is a schematic front view of flexible rolls and associated parts.
Figure 3:
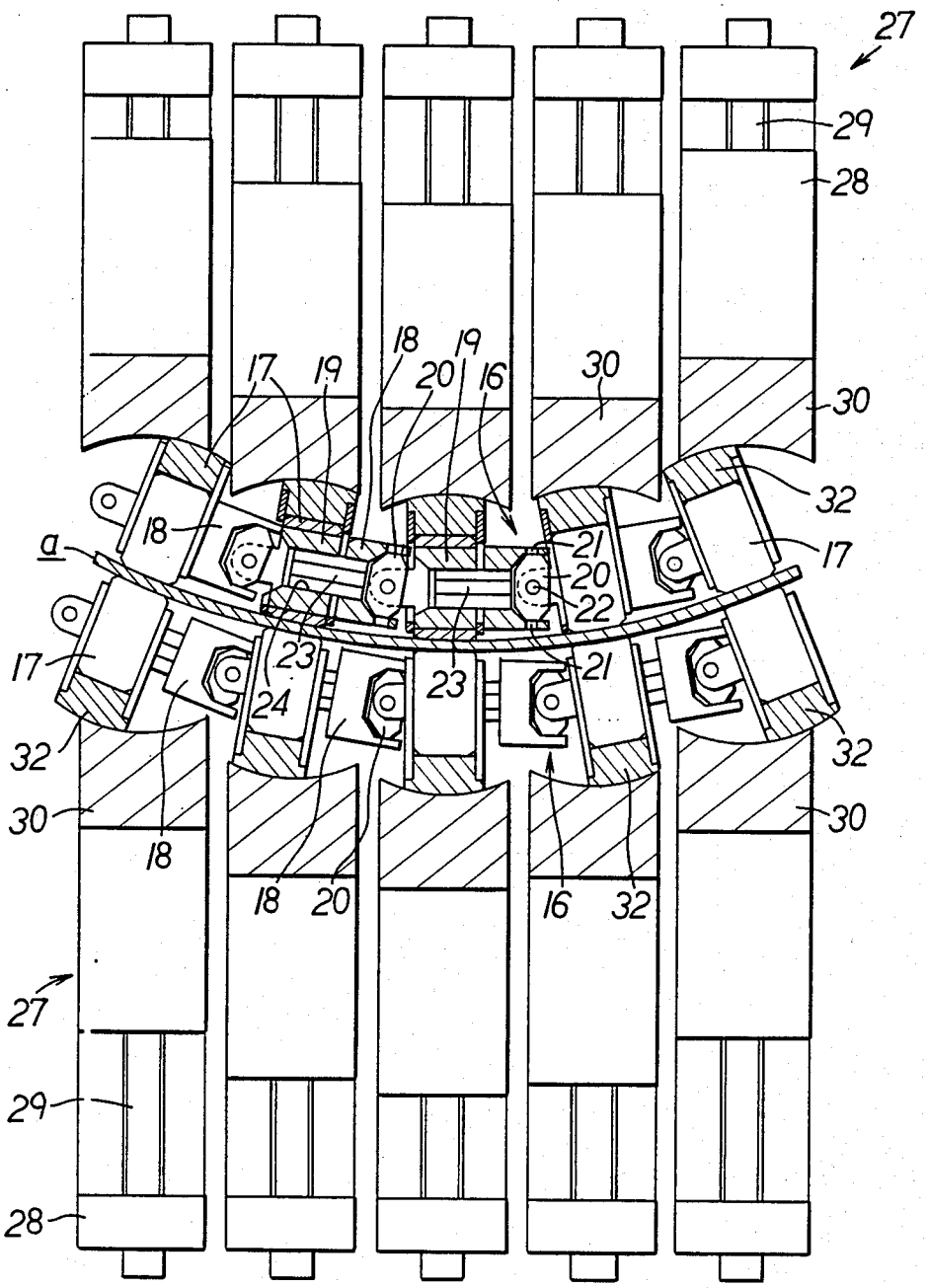
FIG. 3 is a partly sectioned front view on an enlarged scale of the flexible rolls.

As shown particularly in FIGS. 2 and 3, the flexible rolls 13 are each constituted by a plural number of forming roll members 17 which are fitted at predetermined intervals on a flexible rotational shaft 16. This rotational shaft 16 is required to be flexible beyond a curvature to be imparted to the work a, and capable of transmitting rotational power to its entire body. The forming roll members 17 which are fitted on the rotational shaft 16 at predetermined intervals are brought into contact with the work a for forming the latter. The width of the gap between the forming roll members 17 should be adjustable according to the condition of flexure of the rotational shaft 16 as explained hereinafter.

For this purpose, the rotational shafts 16 are constituted by a series of universal joints connecting short segmental shafts 18 and 19 successively rotatably about two perpendicularly intersecting shafts 21 and 22 of a joint member 20 interposed between the adjacent segmental shafts 18 and 19. Each universal joint has a spline shaft 2 protruded from its segmental shaft 18, and a bore 24 formed into the other segmental shaft 19 for receiving a spline shaft 23 of the adjacent universal joint such that they are slidable relative to each other but lockable for transmission of rotation. The spline joint may be replaced by a key and keyway joint if desired.

Figure 4:
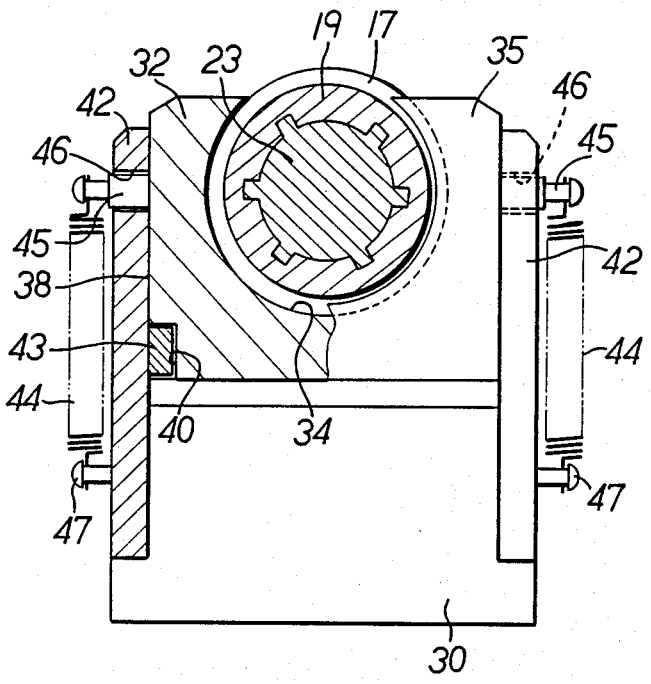
FIGS. 4 and 5 are partly cutaway enlarged side and front views of bearing and centering bearing members which support the respective forming roll members.
Figure 5:
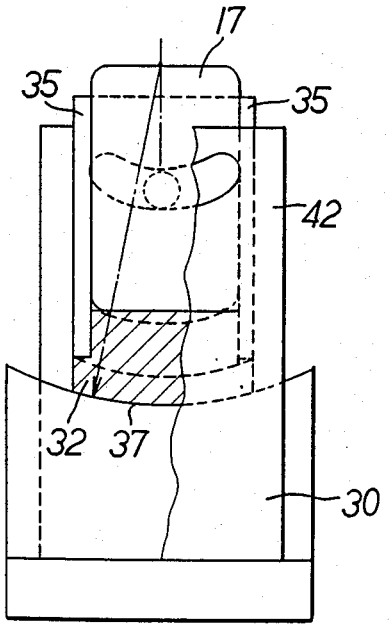

The forming roll members 17 are fixedly fitted on the segmental shafts 19 of the respective universal joints, and as shown in FIGS. 3 to 5, they are directly supported by shaft support mechanisms 27 which are located on the upper and lower sides of the opposing flexible rolls 13.

These shaft support mechanisms 27 include centering bearing members 30 which are supported on the machine frame 11 in the respective roll stands 28 and vertically adjustable by means of feed screws 29, supporting thereon roll support bearing members 32. The bearing members 32 are provided with a notched cylindrical pocket 34 to receive therein a forming roll member 17 with part of the roll member 17 protruded out of the pocket 34. The opposite ends of the pocket 23 are closed with end plates 35 which are provided with bores for passing the rotational shaft 16, thereby preventing dislocation of the forming roll in the axial direction. The contact surface 37 between the bearing member 32 and the centering bearing member 30 is formed in a cylindrically curved surface having its center at an upper center portion of the forming roll member 17, rocking the axis of the forming roll member 17 in a vertical plane when the bearing member 32 is tilted by relative sliding movement on the contact surface 37. In addition, the bearing member 32 is provided with guide grooves 40, concentrically with the afore-mentioned contact surface 37, on a pair of opposing lateral side walls 38 parallel with the axis of the forming roll member 17. On the end walls 42 opposing the lateral side walls 38, the centering bearing member 30 is provided with projections 43 which are slidable in and along the guide grooves 40. A pin 45 is implanted on each lateral side wall 38 of the bearing member 32 and projected through an arcuate slot 46 in the opposing end wall 42 for stopping one end of a coil spring 45, which is tensioned between the pin 45 and a pin 47 projectingly planted on the end wall 42 of the centering bearing member 30. These arrangements serve to smoothen the sliding contact of the bearing member 32 and centering bearing member 30 on the contact surface 37.

The work a is fed through the forming machine by rotational drive of the flexible rolls 13. For this purpose, a gear box 50 is mounted on the base 10, and one ends of the upper and lower flexible rolls are connected to rotational shafts 52 which are rotated in opposite directions by a motor, not shown, through universal joints 51.

By arranging the flexible rolls 13 and shaft support mechanisms 27 in this manner, the flexible rolls 13 can be flexed into an arbitrary curved form by vertically shifting the centering bearing members 30 and bearing members 32 to suitable positions on the respective roll stands 28. Namely, upon moving up and down the centering bearing members 30 by way of the roll stands 28, the bearing members 32 are slid on the contact surfaces 37 and automatically turned according to the vertical positional relationship with adjacent centering bearing members 30 to put the flexible rolls 13 in a desired curved form. In this instance, it is necessary to contract or extend the flexible rolls 13 in the axial direction pursuant to variations in their postures. Since the adjacent universal joints are slidably connected by the fitting engagement between the spline shafts 23 of the segmental shafts 18 and the holes 24 of the segmental shafts 19, the forming roll members 17 are automatically maintained at suitable intervals.

For gripping and forming the work a between a pair of upper and lower flexible rolls 13, needless to say, the two flexible rolls are positioned parallel with each other, forming therebetween a clearance substantially corresponding to the thickness of the work a.

When the flexible rolls 13 are flexed, the heads of the respective forming rolls 17 are turned according to the flexural deformation. In so doing, the opposing faces of the paired upper and lower forming roll members 17 are constantly held in face-to-face positions without deviations in the axial direction of the roll, as shown in FIG. 3, since the tilting movements of the forming roll members 17 are guided by the cylindrical curved surface of the centering bearing member 30 with a radius of curvature having its center in an upper center portion of the corresponding forming roll.

Flexing the flexible rolls 13 into a desired shape in this manner, the entrance and exit rolls 12 and 14 are also adjusted to suitable heights prior to gripping a work a between the upper and lower flexible rolls 13. Upon advancing the work a by rotating the flexible rolls 13, the work is three-dimensionally formed to shape by undergoing a transverse deformation which is delimited by the shape of the flexible rolls 13, as well as a longitudinal deformation depending upon the vertical positions of the inlet and outlet rolls 12 and 14 relative to the intervening flexible roll 13.

The above-described forming apparatus employs forming roll members 17 which have a cylindrical circumferential surface. In this case, as the work a is deformed to a shape which is defined by the forming rolls 17, the work portions which are gripped by the paired forming roll members 17 do not undergo deformation, namely, the work undergoes deformation only in the regions between the gripped portions or in the regions which are not gripped by the paired forming roll members 17. Therefore, there may occur a large retrocession from the formed shape after such a forming operation in case of a work with a large springback.

Figure 6A:
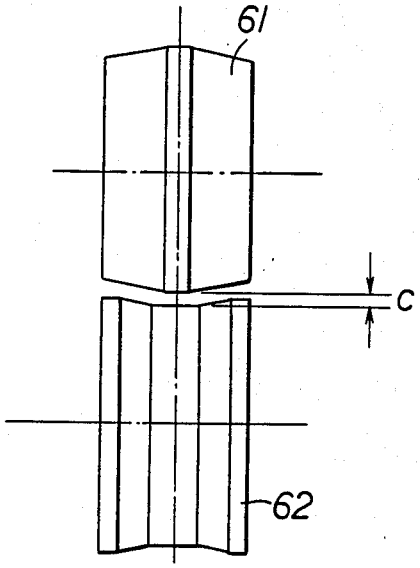
FIGS. 6 A and 6 B are front views of paired upper and lower forming roll members of modified constructions.
Figure 6B:
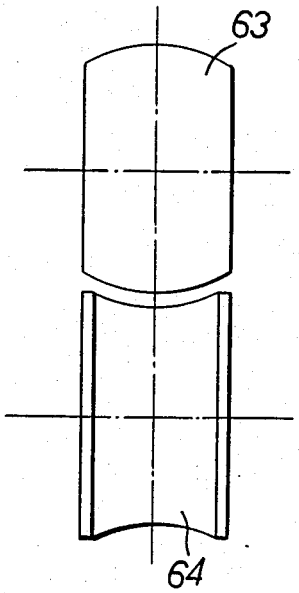

For works with a large springback, there may be employed forming roll members 61 and 62 as shown in FIG. 6 A or forming roll members 63 and 64 as shown in FIG. 6 B. The forming rolls 61 and 62 of FIG. 6 A are channel type male and female rolls, and the forming rolls 63 and 64 of FIG. 6 B are arcuate type male and female rolls. In a forming operation using rolls of this sort, the bending deformation in the transverse direction of the work is imparted by the paired forming roll members, without positively bending the work portions which are not in contact with the roll members. Accordingly, the work is strongly bent between the opposing forming roll members 61 and 62 or roll members 63 and 64, but the curved shapes on the circumferences of the forming roll members 61 and 62 or roll members 63 and 64 are formed in a smaller curvature than the shape of the plate to be formed, combining the bending action of the forming roll members as shown in FIGS. 4 and 5. The forming roll members of other shapes may be employed, depending upon the shape to be imparted to the work.

When the vertical positions of the bearing members 32 are sequentially varied by driving the feed screws 29 of the roll stands 28 in synchronism with the feed of the work a by means of a drive mechanism, not shown, to vary sequentially the bending form of the flexible rolls, the work a can be bent into a complicated three-dimensional shape. However, in a case where the forming roll members as shown in FIG. 6 A or 6 B are used, the sequential variation of the vertical positions of the bearing members 32 is limited to a certain range as will be explained hereinlater.

Needless to say, the vertical positions of the respective forming roll members can be set or shifted by numeric control for varying the shape of the flexible rolls.

Figure 7:
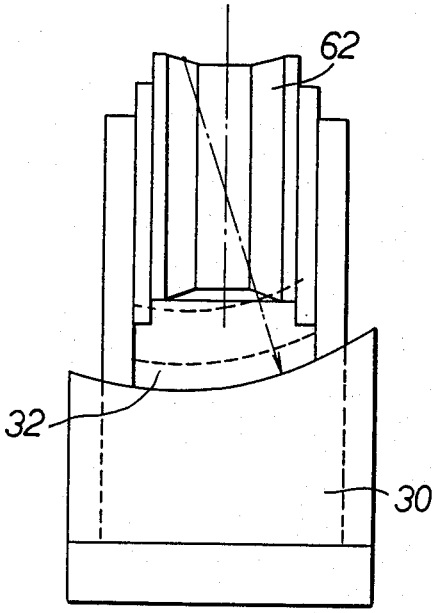
FIG. 7 is a partly cutaway enlarged front view of modifications of the bearing and centering bearing members for supporting the forming roll member.

The contact surface 37 between the centering bearing member 30 and bearing member 32 presents a cylindrical curved surface having the center of its radius of curvature located in an upper center portion of the forming roll member 17. The just-mentioned center of the radius of curvature may be located off the upper center portion of a forming roll member 62 as shown in FIG. 7. In this case, the following secondary effects can be expected.

Namely, when adjusting the heights of the roll stands to set the flexible rolls in a shape conforming with the sectional shape of a double-curved surface to be formed, it is necessary to turn the heads of the forming roll members themselves according to the sectional shape. The arrangements of FIG. 7 permit to turn the roll heads with greater force and more smoothly.

Shown below are the results of Al forming operations using the forming roll members of FIGS. 3 to 5, each flexible roll 13 having, at intervals of about 34 mm, five forming roll members 17 of 24 mm in length and 40 mm in outer diameter.

Figure 8:
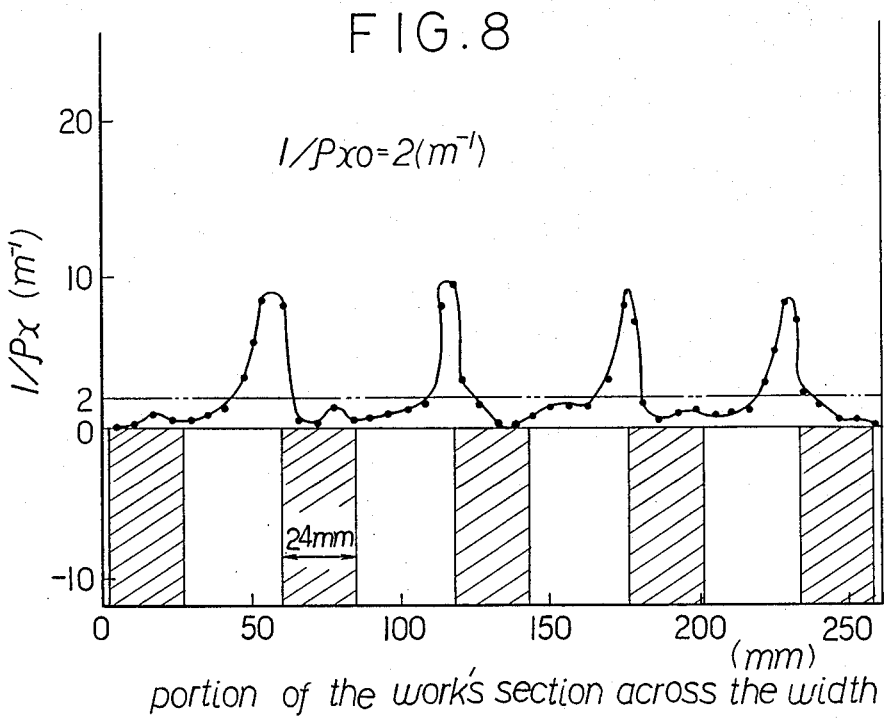
FIG. 8 is a diagram showing the curvature across the width of a work which is formed by the use of forming rolls of FIG. 5.
Figure 9:
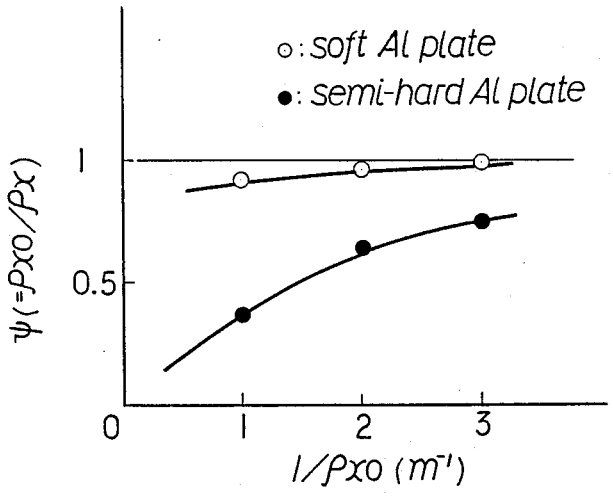
FIG. 9 is a diagram plotting the sectional shape ratios in forming operations of soft Al plates and semi-hard Al plates.

FIG. 8 shows the distribution of curvature in various portions of a section across the width of a formed work a. In case of FIG. 8, a soft Al plate of 2.0 mm in thickness(t) and 260 mm in width(b) was used as a work. The hatched area in FIG. 8 indicate the regions in contact with the forming roll members. Shown in FIG. 9 is the ratio $\psi$ of sectional shape in forming operations using soft and semi-hard Al plates of 2.0 mm in thickness and 260 mm in width. Here, the ratio is expressed as $\psi=\rho xo/\rho x$ where $\rho xo$ is the sectional radius of curvature of the flexible roll and $\rho x$ is the sectional radius of curvature of the work.

The four peaks of sectional curvature in FIG. 8 implies that the work is bent largely in these portions, with more conspicuous local deformations as compared with a uniform arc which is indicated by two-dot chain line in the same figure. However, these local deformations can be suppressed to a certain extent by increasing the length of the roll members and narrowing the roll intervals. It is also seen that the above-mentioned four peaks appear at one ends of the forming roll members. Presumably, this is because the center of rotation of the universal joint is not located at a median point between the adjacent roll members, and deviated toward one roll member as seen in FIG. 3. Accordingly, reduction of these peaks can be expected if more considerations are paid to the location of the rotational center.

As seen from FIG. 9, the amount of spring-back varies depending upon the strength of the material. Therefore, it is necessary to take into account the spring-back prior to the forming operation.

Figure 10:
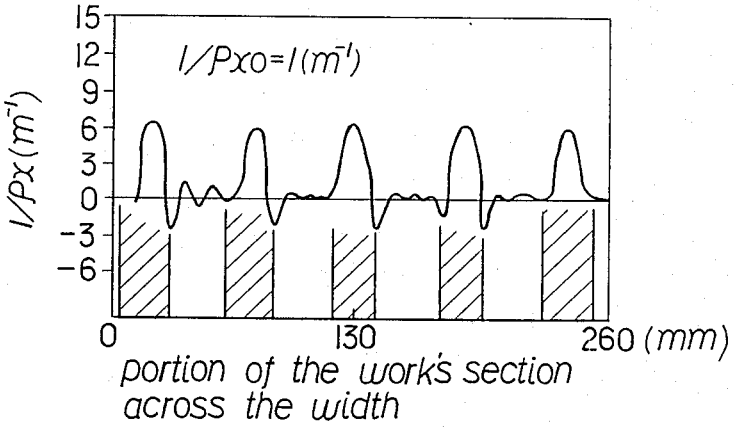
FIG. 10 is a diagram plotting distribution of curvature in section across the width of a work formed by the use of forming rolls as shown in FIG. 6 B.

FIG. 10 shows the curvature distribution in the transverse section of works a, semi-hard Al plates of 2.0 mm in thickness and 260 mm in width, in a forming operation using forming rolls of FIG. 6. The hatched areas in FIG. 10 indicate the regions in contact with the forming roll members. In this example, five peaks appear in the sectional curvature distribution in the regions in contact with the forming roll members. As compared with the local bending deformations by the flat rolls, these peaks are less steep and widened over the width of the roll members.

Further, a negative peak appears in the vicinity of the right end of each forming roll member, indicating an inverse bending which is undesirable in a double-curved forming. This is caused by abutment of forming roll shoulders due to deviation of the rotational centers of the universal joints from the median points between the adjacent forming roll members. This problem can be solved by employing other roll construction, for example, the construction of FIG. 7 in which the center of each universal joint is located closer to the median point between adjacent forming roll members.

Figure 11:
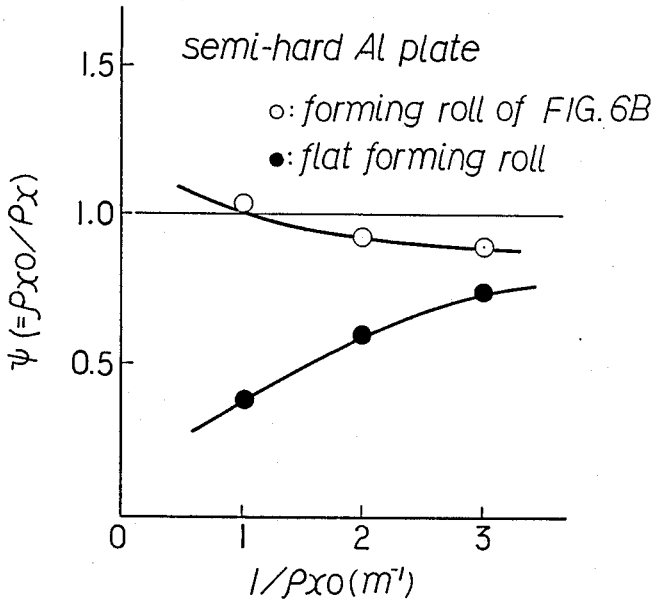
FIG. 11 is a diagram plotting the sectional shape ratios in forming operations employing the forming rolls of FIG. 6 B.

The diagram of FIG. 11 shows the ratio of sectional shape of a semi-hard Al material of 2.0 mm in thickness and 260 mm in width formed by the use of forming rolls of FIG. 6 B, along with results obtained from flat forming roll members. Although the value of $\psi$ is small in case of flat rolls due to a large spring-back, it is close to 1 in case of the forming rolls of FIG. 6, indicating that the work could be formed to a shape substantially equal to the preset shape of the flexible rolls.

As will be understood from FIG. 10, the bending angle of the flexible rolls is determined depending upon the shape of the forming roll members. In order to form a plate into a longitudinally varying shape by varying the shape of the flexible rolls, it is necessary to vary the bending angles which are alloted to the respective roll members. For example, the bending angle can be varied by varying the gap width between the opposing roll members.

Figure 12:
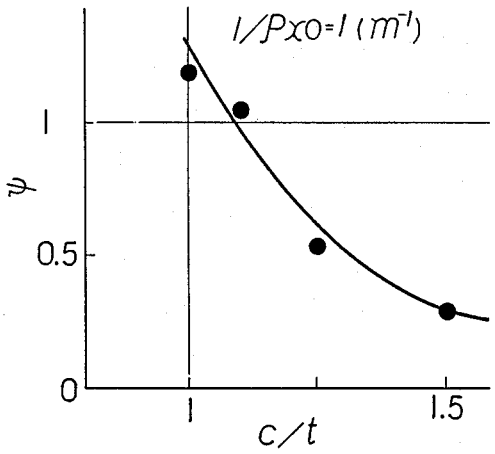
FIG. 12 is a diagram showing the influence of the width of the roll clearance on the ratio of sectional radius of curvature in forming operations using forming roll members as shown in FIG. 6 A.

FIG. 12 shows the influence of the gap width c on the ratio of sectional shape, observed by changing the gap width between the upper and lower forming roll members as shown in FIG. 6 A. As seen therefrom, smaller the gap width c, greater becomes the ratio $\psi$. Consequently, it was revealed that the value can be adjusted by varying the gap with c.

Figure 14:
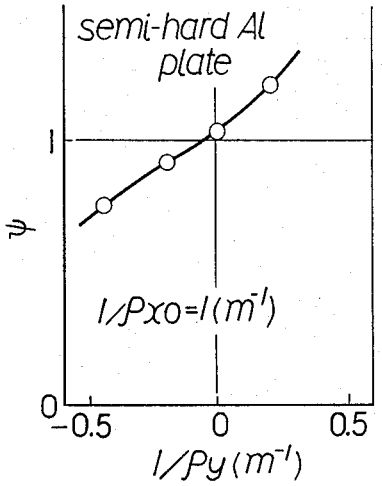
FIGS. 13 and 14 are diagrams showing the influence of the longitudinal curvature on the sectional shape ratio of formed works in composite-curvature surface forming operations, FIGS. 13 and 14 showing the results obtained by the use of forming rolls as shown in FIGS. 5 and 6, respectively.
Figure 13:
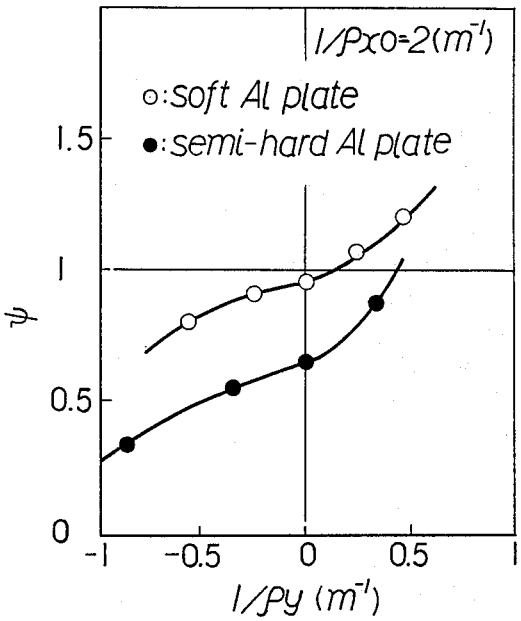

FIGS. 13 and 14 show the results of an experiment studying the influence of the longitudinal curvature of works on the sectional shape ratio in a double-curved surface forming operations imparting the works with a longitudinal curvature ($1/\rho y$) by adjusting the heights of the entrance and exit rolls located upstream and downstream of the flexible rolls. FIG. 13 shows a case employing flat forming roll members as shown in FIGS. 4 and 5, while FIG. 14 shows a case employing forming roll members as shown in FIG. 6 A. In these figures, $1/\rho y>0$ means a bowl type double-curved surface and $1/\rho y<0$ a saddle type double-curved surface. Since the value of $\psi$ varies depending upon $1/\rho y$, a desired double-curved surface can be obtained by setting the shape of the flexible rolls taking into account the variation in $\psi$.

What is claimed is:

1. An apparatus for forming a double-curved plate, comprising:

a pair of flexible rolls located perpendicularly to a path of travel of the work in a position between vertically adjustable entrance and exit rolls and having a plural number of pairs of opposingly located forming roll members fitted at predetermined intervals on a rotational shaft which is both flexible and axially extendable;

bearing members supporting said roll members;

means for independently adjusting a degree of tilting of each of said pairs of roll members in a plane perpendicular to said path of travel; and rotational drive shafts connected to said flexible rolls to rotate said rolls in opposite directions, whereby the shape of said flexible rolls and the vertical positions of said inlet and outlet rolls relative to said flexible rolls provide a double curve for a plate.

2. The apparatus of claim 1, wherein said entrance and exit rolls are constituted by flat cylindrical rolls having the opposite ends thereof supported on a machine frame vertically adjustably through a feed screw system.

3. The apparatus of claim 1, wherein said flexible rolls are each constituted by a series of universal joints each having two segmental shafts connected rotatably about two perpendicularly intersecting axis through a joint member interposed between said segmental shafts, said universal joints being axially slidable by way of said segmental shafts but capable of transmitting rotation to each other.

4. The apparatus of claim 3, wherein each one of said universal joints have a spline shaft protruded from a first segmental shaft and engaged in a bore in a second segmental shaft of an adjacent universal joint for relative sliding movements.

5. The apparatus of claim 3, wherein said flexible rolls include forming roll members fixedly fitted on said segmental shafts of said universal joints and directly supported by shaft support mechanisms located above and beneath said flexible rolls.

6. The apparatus of claim 5, wherein said shaft support mechanisms each include a centering bearing vertically adjustably supported by a feed screw of a roll stand mounted on said machine frame, supporting a roll supporting bearing member on said centering bearing tiltably in a plane perpendicular to the path of travel of the work.

7. The apparatus of claim 6, wherein said roll supporting bearing member is provided with a pocket for retaining one said forming roll member rotatably therein, exposing part the circumferential surface of said forming roller member out of said pocket, and contacted with said centering bearing through a curved contact surface with a radius of curvature having the center thereof located in an upper portion of said forming roll member, said bearing member being tiltable by sliding movements relative to said centering bearing to rock the axis of said forming roll member in a vertical plane.

8. The apparatus of claim 7, wherein said contact surface between said centering bearing member and said bearing is formed in a cylindrical curved shape with a radius of curvature having the center thereof in an upper center portion of said forming roll member.

9. The apparatus of claim 7, wherein said contact surface between said centering bearing member and said bearing is formed in a cylindrical curved shape with a radius of curvature having the center thereof at a point axially deviated from an upper center portion of said forming roll member.

10. The apparatus of claim 1, wherein said pair of flexible rolls are constituted by a number of opposingly located forming roll pairs having cylindrical circumferential surfaces.

11. The apparatus of claim 1, wherein said opposingly located forming roll pairs have channel-like male and female circumferential surfaces.

12. The apparatus of claim 1, wherein said opposingly located forming roll pairs have arcuately shaped male and female circumferential surfaces.

* * * * *